US007018257B2

(12) United States Patent
Courtney

(10) Patent No.: US 7,018,257 B2
(45) Date of Patent: Mar. 28, 2006

(54) VOLUME AMPLIFIED COMPRESSED GAS LIFE JACKET AND LIFE RAFT INFLATOR

(76) Inventor: William L. Courtney, 1990 Hwy. One, Elk, CA (US) 95432

( * ) Notice: Subject to any disclaimer, the term of this patent is extended or adjusted under 35 U.S.C. 154(b) by 0 days.

(21) Appl. No.: 10/844,594

(22) Filed: May 12, 2004

(65) Prior Publication Data

US 2005/0130516 A1 Jun. 16, 2005

Related U.S. Application Data

(60) Provisional application No. 60/470,463, filed on May 13, 2003.

(51) Int. Cl.
*B63C 9/19* (2006.01)

(52) U.S. Cl. ..... 441/93; 441/96; 222/5

(58) Field of Classification Search ..... 441/92–97; 222/5
See application file for complete search history.

(56) References Cited

U.S. PATENT DOCUMENTS 3,905,755 A * 9/1975 Aske ..... 431/344
4,635,754 A * 1/1987 Aschauer et al. ..... 182/3
6,220,909 B1 * 4/2001 Aschauer et al. ..... 441/80
6,494,756 B1 * 12/2002 Michaud et al. ..... 441/41

* cited by examiner

*Primary Examiner*—Andrew D. Wright
(74) *Attorney, Agent, or Firm*—Daniel S. Polley, P.A.

(57) ABSTRACT

A multifunction manually oriented inflator to amplify the volume of gas provided for low-pressure inflation of multiple bladders. A default operation can be as a high pressure fixed-volume inflator. A shut off valve preserves excess gas supply while regulated flow allows optimizing volume versus rate of inflation and risk of aspiration. A detachable low-resistance check valve-coupler allows the valve to also serve as an oral inflate and rapid deflate valve for improving volume amplification. Audible alarms distinguish functional inflation from gas wasting over-inflation. Conserved gas can be used to inflate or pressurize additional survival devices or operate signal horns. A locking mount can align and secure a cylinder adjacent the piercing mechanism. Spent cylinder threads can be degraded preventing reinstallation of a micro-pierced cylinder.

20 Claims, 10 Drawing Sheets

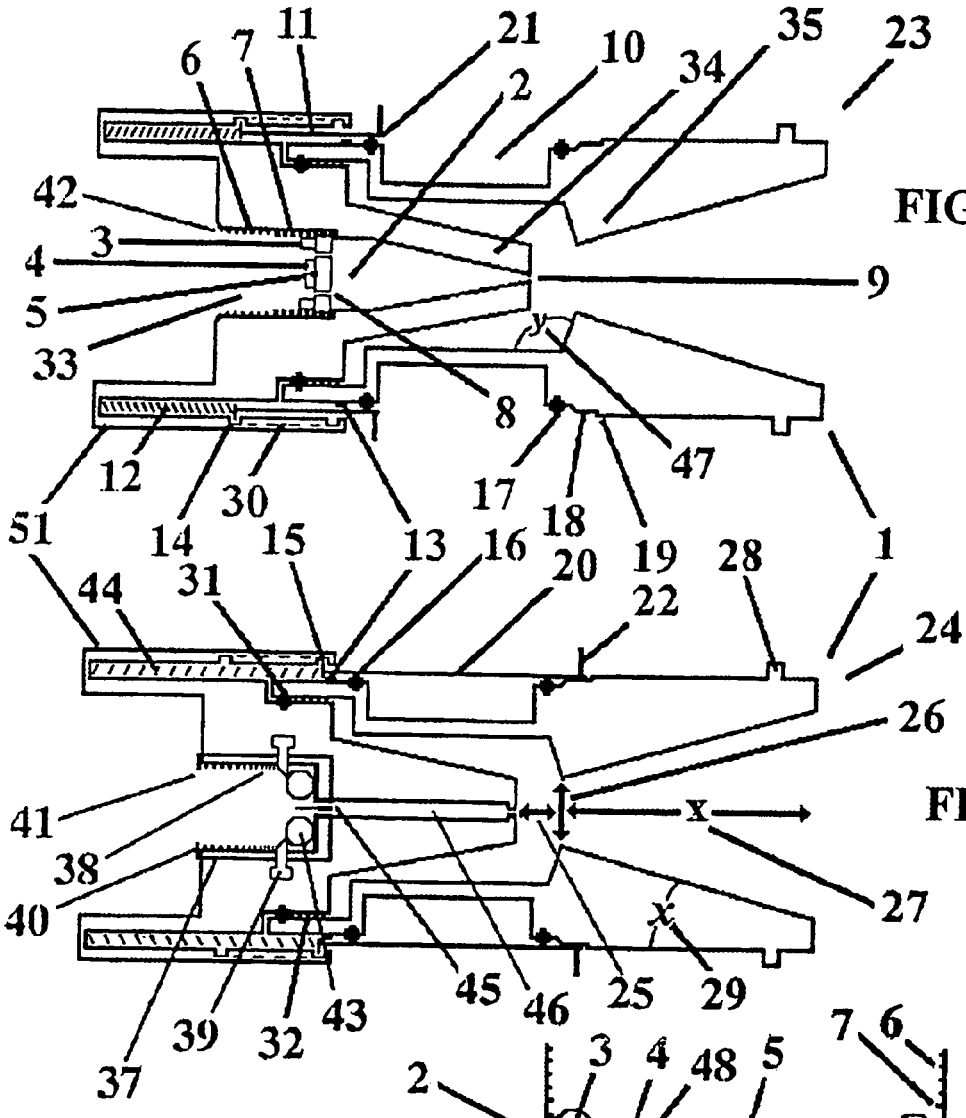
FIG. 1a
FIG. 1b
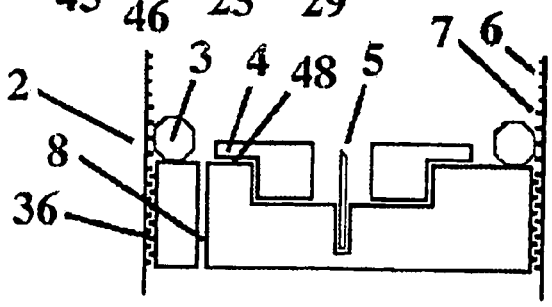
FIG. 1c

VOLUME AMPLIFIED COMPRESSED GAS LIFE JACKET AND LIFE RAFT INFLATOR

This application claims the benefit of and priority to U.S. Application No. 60/470,463, filed May 13, 2003, which is incorporated by reference.

FIELD OF THE INVENTION

The present invention relates to the use of compressed gas for rapid high-pressure low-volume direct inflation or slow low-pressure high-volume indirect inflation or a range of intermediate rates and volumes for signaling during an in-water emergency. In particular the current invention relates to the regulated use of high, low and intermediate pressure and inverse volumes for protection of the airway, for protection from hypothermia and for audible and visual signaling of rescue efforts. The present invention also particularly provides a volume amplified compressed gas life jacket & life raft inflator; manually oriented injector, inspirator or venturi amplified, variable pressure, rate, duration and/or displacement inflator with an air horn and/or whistle.

BACKGROUND OF THE INVENTION

Inflatable life jackets due to their ability to quickly place strong buoyant moments where needed about the body of an unconscious Man Over Board ("MOB") are usually able to provide superior corrective turning performance relative to inherently buoyant Personal Flotation Devices ("PFDs"). The foam life jacket if shaped identical to an inflatable life jacket may also provide superior performance. However the shape of an inflatable life jacket is acceptable in that it is water activated or manually activated only in an emergency. Once in the throes of a water emergency the large anterior displacement is no longer a compliance issue. Until inflated the stored inflatable PFD is low profile and consequently comfortable to wear until needed.

The foam PFD while considerably cheaper than an inflatable PFD, compromises performance for comfort. When the foam PFD is worn routinely, an anterior foam block sufficiently large to provide airway protective corrective turning can be so bulky as to be incompatible with either vocation or avocation. As the amount of foam increases from the 15 lbs. provided by many Type III to the 24 lbs. of the Type II to the 35 lbs. of a Type I, comfort and compliance falls off rapidly. The Type I Off shore PFD being can be so oppressive that it typically never worn until after the onset of a marine accident. The recreational boater is strongly encouraged to "Boat Smart From The Start" meaning to wear your life jacket not carry it. Continuous use has led to the popularizing or the Type III boaters vest which has little to no corrective turning capacity.

Over six hundred boaters drown a year attributed in large part to their failure to wear a life jacket or PFD at the time of the accident. While law requires boaters to carry one PFD for each person on board a vessel, in an emergency PFDs become stuck beneath an over turned vessel, beneath the seat or in the lazaret where stowed. If the PFD is found they are very hard to don while floating in water. Fifty per cent of the 65 fatalities that occur each year while wearing a life jacket are attributed to PFDs incorrectly donned or adjusted. The practice of water donning is understood to be so difficult that it currently is not assessed during the USCG/UL PFD approval process.

Compared to foam PFDs inflatable PFDs are very comfortable leading to increased compliance with continual use.

However, this clear advantage is only available at a cost, a cost so high as to be prohibitive for many family boaters. The inflatable PFD purchase price and maintenance cost are directly proportional to the size of the CO2 cylinder. The 16 gm CO2 that generates approximately 16 pounds of displacement, costs approximately a dollar because the 16 gm cylinder is produced in mass quantities for many uses. However available 16 gm PFDs usually do not provide sufficient torque to protect the airway. Current life jackets employ inflators which operate by piercing the compressed gas cylinder releasing the gas which then expands. There is a linear relationship between the number of grams of CO2 attached to current life jacket inflators and the pounds of inflatable displacement that can be generated from that CO2.

Cylinders other than the 16 gram CO2 are very expensive; a 24-gram costs around $12.00 retail and a 38-gram $18.00. New 1F inflator adds onto the prior cost the additional costs of a custom 38 gram cylinder and a custom plastic marking device that is broken off during installation so that the cylinder can not be installed a second time. This is to assure that a spent cylinder is not re-installed during re-arming. This technology is so new that the cost for this assurance of cylinder seal integrity has yet to be determined but predictably it will exceed the current $18.00 per cylinder.

Due to the prohibitive cost of compressed gas inflation, all USCG Type I to V PFDs have a single inflator and a single compressed gas cylinder. While Safety Of Life At Sea ("SOLAS") class inflatable Life Jackets do require dual inflators and cylinders, the cost of SOLAS class life jackets restricts their use to profitable commercial carriers.

Studies have shown that inflatable life jackets after being in the field for 6 months suffer a 50% loss of reliability. Spent cylinders are reinstalled or cylinders vibrate away from the piercing means so that neither manual nor water activated inflators are capable of inflating the attached PFD. While recent 1F inflators address some of the issues the increased cost will only further restrict the high performance of inflatable life jackets to those with significant financial resources.

There are no known triple chambered PFD systems. Additionally, the retail cost of including a component could end up being approximately four times the wholesale cost. At a wholesale cost of $9.00/38 gm CO2 the customer could end up paying $36.00. Thus, using current 38-gram cylinders for a triple chambered PFD could add $100.00 to the final purchase price. The new modified 38 gm cylinders required for the 1F would add even more the purchase price. The wholesale price for the 1F inflator can be $12.00 which could add $48.00 to the retail price for each inflator. Three inflators could contribute $147.00 to the retail cost. The combined retail cost of the inflators and cylinders for a triple chambered PFD thus could be $250.00 plus the additional costs for the custom cylinder and collar. This price does not include the cost of the radio frequency welded jacket, sewn cover, harness and required pamphlet.

In addition to the costs of inflating a triple chambered PFD, the inclusion of three cylinders and three inflators adds considerable bulk and weight to a garment integrated PFD, adversely affecting compliance with 'continuous use'.

Current compressed gas inflation systems which are restricted to expansion of compressed gas have restricted the design of life jackets to single chambered products. Clearly the compressed gas inflation means required to inflate the personal life raft has blocked it from consideration for routine inclusion in PFDs or garments.

While certain large multi-person life rafts and buoyant Airline slides have self-orienting buoyant aspirators. These single use commercial aspirators are sized to the device to be inflated and rely upon bulky self-orienting collars which are required to assure that the bladder will not be filled with entrained seawater rather than entrained air. They are very large, heavy, bulky and expensive devices incompatible for inflation of continuously worn life jackets yet alone for the inflation of single-use disposable Mylar life jacket or signaling devices.

Current CO2 inflators approved for use with UL/USCG Tested & Approved inflatable life jackets rely upon manual or water activated rapid discharge of the cylinders entire contents into the air retentive bladder. The amount of displacement generated is in direct proportion to the weight of liquid CO2 in the cylinder. Classically inflatable life jackets rely upon a 16 gm, 25 gm or 38 gram CO2 cylinders generating roughly 1 lb displacement/gm during direct rapid high-pressure inflation.

Current life jacket inflators are required to roll the victim from a face down position into an airway protected face up position in 5 seconds. Design objectives of current UL listed inflators are to rapidly pierce the cylinder seal then reduce obstruction to gas flow. In one design the rapid and complete transfer of gas if facilitated by inverted mounting of the cylinder so that the liquid CO2 is blown into the chamber where it can rapidly expand with the ambient pressure sustained by the constriction of the cylinder walls. For the unconscious victim this rapid clearing of the airway is essential and that remains the default operational mode of the disclosed inflator.

Over and above USCG Type III, II Near Shore or Type I Offshore PFDs, SOLAS class inflatable life jackets as dictated by the International Maritime Organization ("IMO") are required to have redundant chambers, cylinder and inflators to mitigate the possibility that failure at one point could lead to complete loss of all buoyant assistance. In one design both chambers share a common wall. One of the two chambers is protected by an over pressure valve so in the event both the manual and automatic inflators are activated, the entire contents of one cylinder/chamber is safely spilled out through the over pressure valve. In dual inflator life jackets the second is only present as a back up and yet through volume amplification could be used to inflate the life raft, mitigating hypothermic risk, markedly extending survival.

Thus there remains the need for a user oriented therefore low bulk, low cost, low profile, and lightweight volume amplifying life jacket CO2 inflator to which the present invention is directed.

SUMMARY OF THE INVENTION

The present invention provides a user oriented therefore low bulk, low cost, low profile, and lightweight volume amplifying life jacket CO2 inflator. The inflator's default operation can be to function as a traditional rapid, high-pressure inflator to supply timely corrective for the unconscious emergency. Yet if the victim is conscious then the compressed gas flow can be reduced through valving to conserve the gas to serve multiple purposes across time. In particular, a slow, low-pressure volume-amplified inflator will allows the same cylinder to inflate first the life jacket then also inflate a life raft or other object. Inclusion of a valve within the volume-amplified inflator allows the same cylinder after quickly inflating a primary life jacket to be turned off. At a latter time the same cylinder and inflator can be use to inflate a secondary life support device to assist efforts at thermal protection or to provide a full-face shield to protect the MOB's airway from breaking seas or driving rains. In addition the parsimonious use of the compressed gas will allow the same cylinder to slowly inflate a single use Mylar life raft. Once stabilized the same cylinder and inflator can then be used to top off a distress signal device or power a piercing air horn. An inflator integrated oscillator alerts remaining crew to the onset of a MOB event. While an intake vent oscillator alerts the survivor to overfilling of the bladder so that they can quickly shut off the gas supply thereby saving the remaining compressed gas for other life saving uses. The volume amplified inflator allows the very inexpensive 16 gm CO2 to inflate Type I or SOLAS class life jackets reducing the cost of the high performance 38 lb. life jackets by approximately 30% and increasing access to the inflatable life jackets by a wider socio-economic strata. The same inflator can include a nylon lock thread to identify successful installation as well as prevent the cylinder from vibrating away from the pierce means. The incorporation of the threading process into the inflation process of life saving devices assures that in the event of deferred maintenance in which the cylinder has vibrated away from the pierce means that the cylinder will be advanced until successful puncture and release occurs. The inclusion of a thread degrading system damages the spent cylinder's thread so that it cannot be re-installed, preventing one of the largest problems with the 6F inflator.

As a comprehensive example of use of the present invention (which in no means is considered limiting in any manner), while standing watch alone the sailor is knocked off the sailboat by the boom. Hitting the water dazed, the water activated high-pressure low-pressure compressed gas inflator of the present invention is actuated upon contact with the water to rapidly inflate the life jacket. An integrated audible alarm and the cold water arouse the semi-conscious MOB who positions themselves face up placing the inflator vents, which are normally spring closed, out of the water. Opening the air intake vents the volume amplification quickly completes filling the life jacket. A second audible alarm indicates off-gassing through the intake vents so the operator closes the inflator's valve to conserve the remaining gas and the vent cover springs closed. The survivor can then remove a multi-function signal device from their garment and transfers the compressed gas inflator and cylinder from their life jacket to the signal tube. When the inflator, is held above the water, the volume amplified inflator valve is cracked opened. Flow rate is kept to an absolute minimum and the air intake vents are locked open. The volume-amplified inflator quickly inflates the SOS distress signal tube consuming very little compressed gas.

An audible signal can alert the MOB that the inflator has begun to off-gas through the air intake vent. The MOB can release the vent cover converting the inflator from low-pressure volume-amplified inflation into high-pressure direct inflation and the tube can be topped off to approximately 2.5 psi. The inflator valve is once again closed conserving the remaining compressed gas.

Due to the rapidly cooling temperature of the open ocean water, the MOB usually needs to achieve a water exit strategy if they are to survive for more than 30 to 60 minutes. The sailor suspects he may not be missed until the next watch comes on deck. Consequently the SOS marker can be quickly converted into a Yoke Collar style PFD and donned freeing the garment integrated primary PFD bladder to be released from the garment. Once outside of its fabric configured cover, the primary bladder can be attached to the inflator. When held out of the water, the vent covers are locked opened and the inflator valve just cracked open. A barely perceptible hiss of compressed gas begins converting the PFD into a Personal Life Raft ("PLR"). The MOB is buoyed by their secondary bladder as the raft inflates. Once inflated the inflator vents are closed and the valve opened up converting the inflator into a high-pressure inflator to bring the raft pressure to approximately 2.5 psi. Again the inflator valve and vents can be closed.

Once in the raft, the user can remove the Yoke Collar PFD and reconvert it back into a SOS Distress marker. The marker can be orally inflated to the best of the MOB's ability. The inflator can then be attached and with the air intake vents closed, the valve is opened so that the inflator acts as a high-pressure inflator for the marker. The SOS signal device can be made substantially rigid by approximately 2.5 psi of internal pressure well above the approximately 0.6 psi MOB is typically capable of achieving with their lungs.

A tertiary, single-use, 'Mylar' multifunction bladder can be removed from the MOB's jacket and orally inflated. The tertiary bladder is configured as a Yoke Collar PFD and donned. The bladder can be orally inflated to approximately 0.6 psi. With the ambient air intake vents closed, the inflator can be set up for high-pressure inflation. Once the valve is opened, the PFD is quickly brought up to its approximately 2.5-PSI structural operating pressure.

A small fishing vessel is spotted motoring across the horizon in the distance. A membrane air horn is attached to the quarter turn inflator and the valve cracked open for intermediate rate and pressures creating an ear piercing sound. The boat motors on and the MOB recalls that the survivor sees an average of 5 vessels pass them by before one spots their life raft adrift in the open Ocean. Latter that day another fishing vessel motors onto the horizon and this time stops to fish a drop off. Once the sound of the motor stops, the MOB opens the inflator's valve supplying compressed gas to the air horn and the fishing vessel's rescue brings to a successful end the MOB's potentially life-threatening experience.

The mechanics of amplified inflation as seen above are best when they can be adjusted to a specific application. The use of a central stream of air to entrain ambient air can be a trade off between the volume of air required to fill a bladder versus the need for rapid inflation. At one extreme, maximum volume would take infinitely long while at the other end life jackets according to the IMO are expected to roll the unconscious victim into a face up position in 5 seconds and so require very fast inflation for the unconscious person.

To comply with international standards all current life jacket inflators rely upon direct expansion inflation in which the liquefied gas contained within a cylinder is released converting it to pure gas in seconds. Current life jacket inflators convert 1 gm of CO2 into 1 lb. of displacement. This can be accomplished manually by a sharp jerking motion driving the piercing pin or by a water-activated spring-driven piercing means that perforates the cylinder seal. Ideal the piercing means retracts leaving a large unobstructed opening and rapid conversion of liquefied gas to gas.

The water activated volume amplified inflator of the present invention can be set up to function as a traditional 38 gm 5-second inflator for the unconscious victim. However, if conscious the survivor can convert the water activated into manual and the compressed gas can be conserved such that the user may be able to inflate several bladders including a life raft from the same cylinder.

Volume amplified inflator design whether injector, inspirator or Venturi enhanced includes many elements: the micro-pierce diameter, valve advance and valve orifice design, jet orifice and the absence or presence of a vacuum generating Venturi. If present, the diameter of the Venturi throat, distance of the jet orifice to the Venturi throat, the angle of the Venturi intake as well as length and angle acuity of the Venturi exit all contribute to amount of ambient air that can be captured. The amount of high-pressure gas directed through the Venturi determines the maximum internal bladder pressure that can be reached with air intake vents open. Once that internal bladder pressure is exceeded then the jet will begin to off-gas through the 'intake' vents rather than creating a vacuum to drawing air along as occurs when there is no back pressure.

Once gas begins to escape out the 'intake' vent the vent can be closed with the present invention inflator, thus, converting the low-pressure inflator into a high-pressure inflator with no volume amplification. Once the life jacket is fully inflated, the inflator valve can be closed saving the remaining gas for secondary functions such as inflating distress marking tube, personal life raft and/or operating an air horn.

The maximum displacement generated per gram of compressed CO2 available is not only a function of inflator design and duration of inflation but also of associated valving and connector sizing. A current life jacket inflator allows 1 gram of CO2 to directly expand filling a bladder with pure CO2 at 1–2 PSI generating 1 lb. of displacement. A simple volume amplified inspirator or injector generates about 2 lbs. and Venturi amplified inflator is capable of generating 4 to 10 or 20 lbs. of displacement.

If the survivor is not panicked and places the intake vents out of the water before actuating the inflator of the present invention, if the CO2 cylinder stays vertical so that no liquid CO2 is passed out the inflator, and if the inflator has a variable flow rate valve set to the lowest setting, then a very limited amount of gas jets through the Venturi throat over a long period of time. While the rate of inflation is slower the amount of ambient air entrained is the greatest and consequently the final volume of air moved into the bladder is markedly amplified compared to current expansion inflation.

Finally, CO2 is a small molecule that can escape through tire inner tubes or worn portions of laminated inflatables. When CO2 is used primarily as the driving gas the ambient gas becomes the predominant component in the final mixture. The high percentage of nitrogen and oxygen reduces the gradient driving CO2 through the bladder wall resulting in less structural loss due to CO2 escape in an extended survival scenario.

Thus, the present invention provides an inflator that can quickly provide corrective turning for the unconscious victim, at the cost of consuming the entire 38 gm of CO2 to generate 35 lbs of lift. However, if the victim is conscious the inflator can be physically oriented in a vertical position out of the water then adjusted to inflate the life jacket at a slower rate entraining ambient air in an approximately 4:1 to approximately 20:1 ratio. Once the PFD is filled in the low pressure mode it can be switched to the high pressure mode of operation to increase the pneumatic tension in the PFD. The inflator can then be turned off and detached and the remaining liquid CO2 conserved for inflating a personal life raft or other desired inflatable object. After detaching the inflator from the life raft an air horn attachment can be attached. The most efficient use of compressed gas to achieve the maximal amplification of the final volume of displacement requires the permanent or detachable valve and connecting fixtures to supply the least resistance to flow. A wide bore low durometer flapper valve can supply negligible resistance to the low-pressure flow. The inflator can be disconnected from the valve so a locking cap can provide a long term seal once the inflator had been removed for other low, intermediate or high-pressure applications such as production of high volume audible rescue signal.

BRIEF DESCRIPTIONS OF THE DRAWINGS

FIG. 1 is a lateral view illustrating a seal then micro-pierce compressed gas inflator with valve. Manual or spring loaded vents convert the inflator between rapid high-pressure inflation and slower but high-volume inflation. Injector, inspirators or Venturi can be selected by price and amount of amplification required. The micro-puncture inflator deforms the cylinder threads so that the spent cylinder with its nearly invisible perforation cannot inadvertently be re-installed.

FIG. 2 is a lateral view illustrating volume-amplified inflators of increasing efficacy from a simple continuously operating low pressure with minimal volume amplification. To a high pressure direct or low pressure with minimal amplification. To a Seal-Then-Pierce high or low-pressure, Venturi amplified high-volume inflator.

Figure 5:
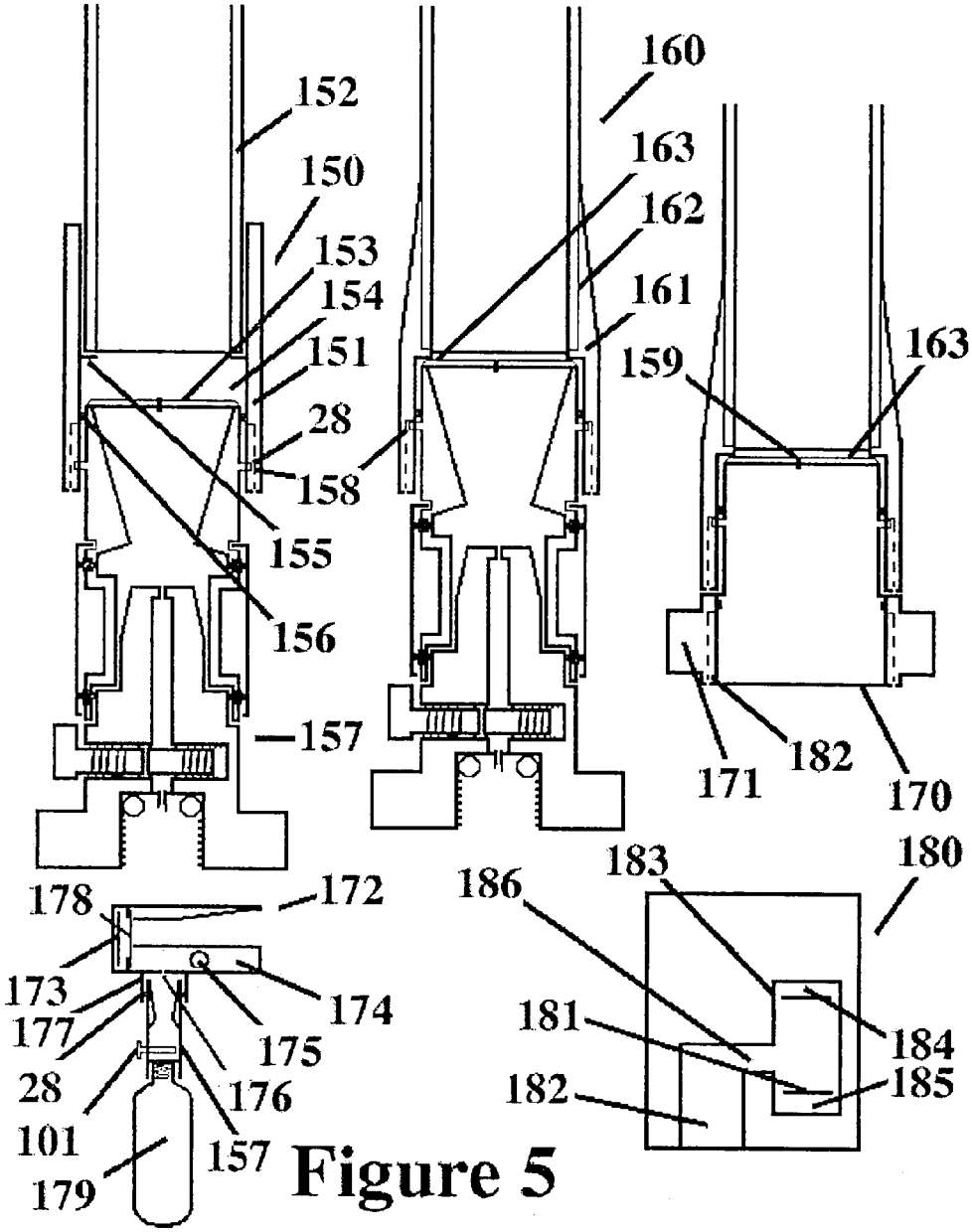

FIG. 5 is a lateral view illustrating a volume-amplified inflator with integrated large bore check valve. A longitudinal valve compresses the gossamer mushroom valve against a valve seat, converting the check valve into a shut off valve. A three part inflator, coupler and connector can allow the inflator to be removed for other applications. The check valve/shut off valve/coupler can also be used as an oral inflate and large bore deflate valve. An air horn can be powered by any excess gas.

Figure 6:
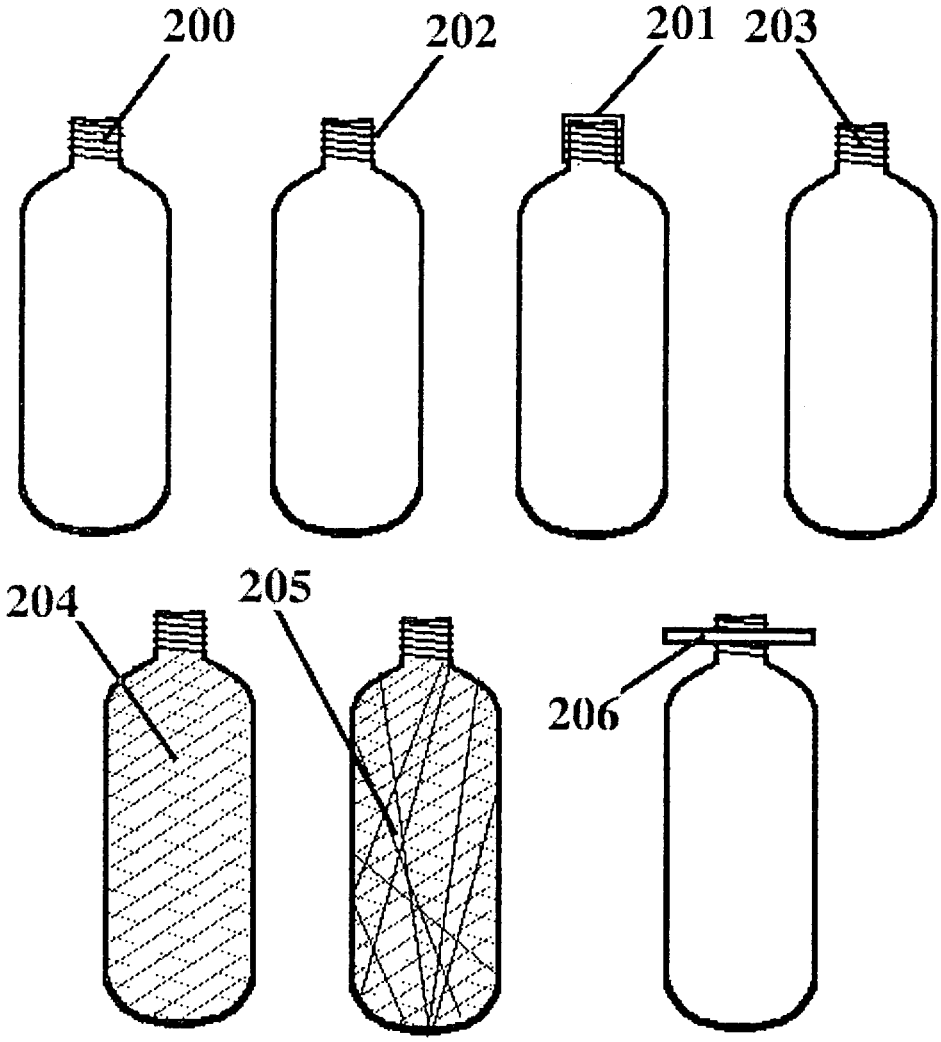

FIG. 6 is a lateral view illustrating a range of spent cylinder detection means. Ideally, the spent cylinder threads can be degraded to the point they not only indicate use but also mechanically prevent a second installation. Alternatively a simple plastic brilliant green cap can be provided which is removed during installation to reveal underlying red threads indicating a used status. A bi-refringent crystalline coating, which changes color as the spent cylinder, collapses during off-gassing can also be provided.

Figure 7:
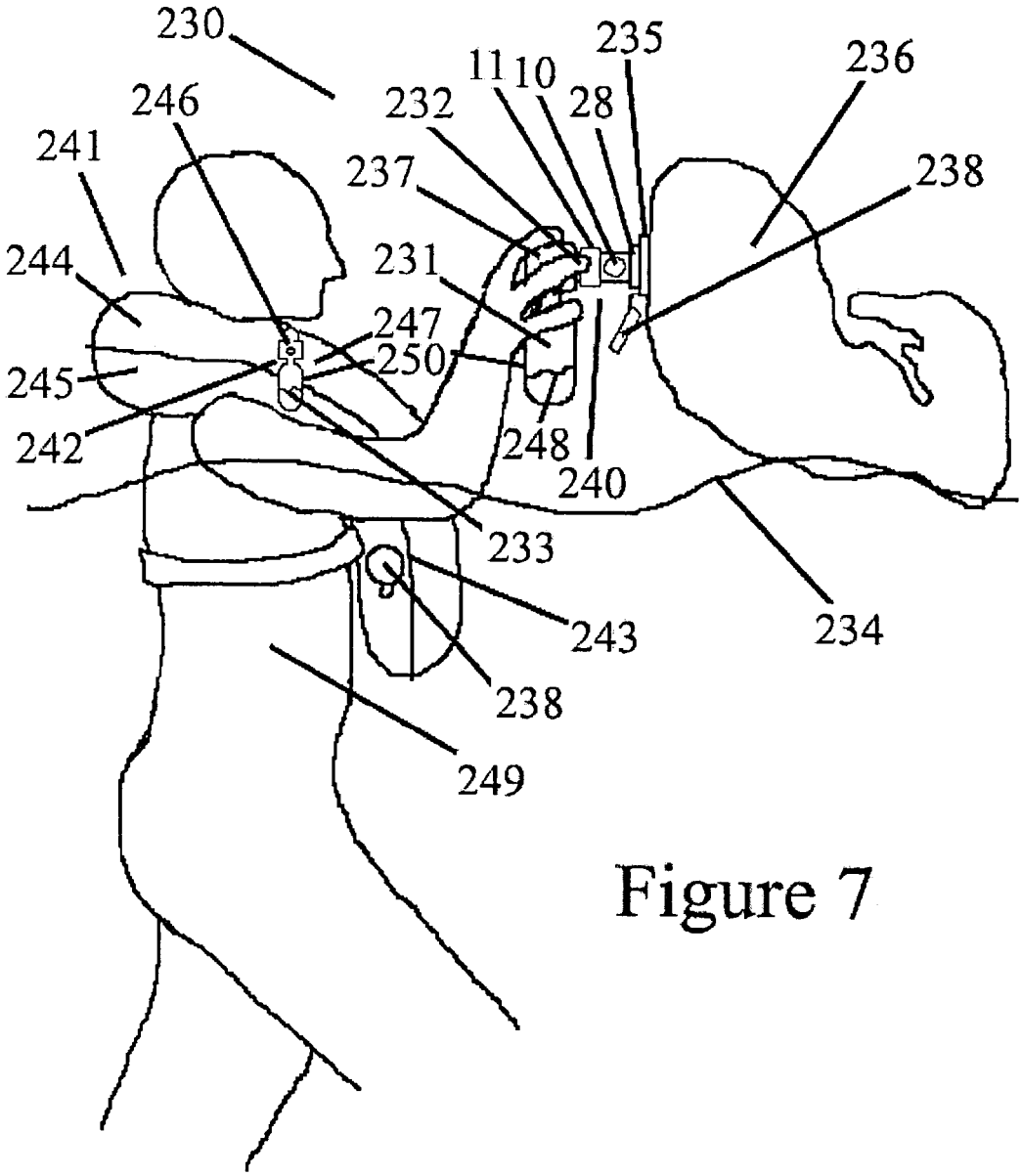

FIG. 7 is a lateral view illustrating a conscious user holding the CO2 cylinder in a vertical position to prevent loss of liquid CO2 as well as to manually convert the rapid high-pressure low-volume inflator into a low-pressure volume amplified inflator by retracting the venturi vent cover. The volume amplifying means in this case is a retrofit venturi mounted between an existing UL Approved inflator and the life raft to be inflated. The inflator and cylinder can be removed from the redundant chamber in the life jacket.

Figure 8:
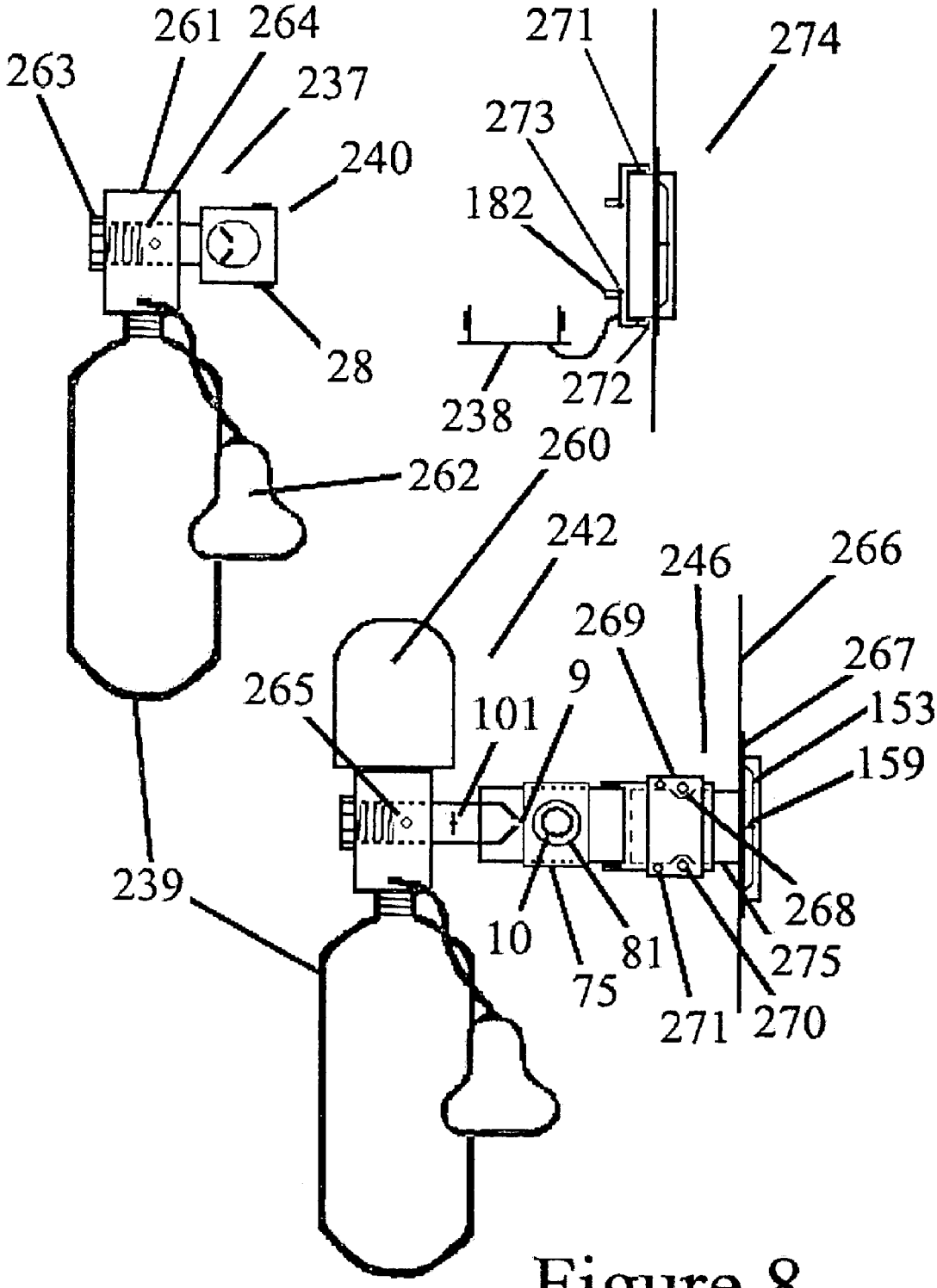

FIG. 8 is a lateral view of UL listed inflators that can be retrofitted with venture amplification.

Figure 9:
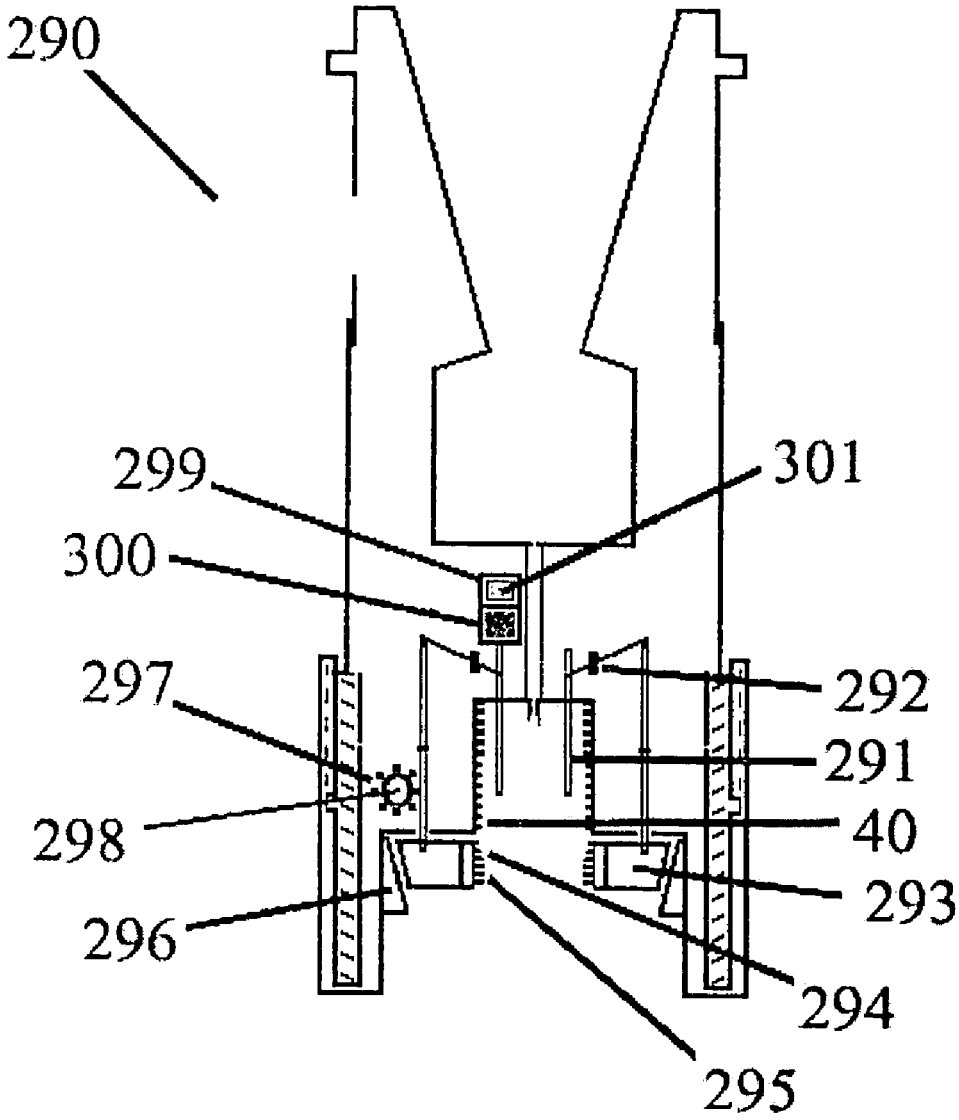

FIG. 9 is a lateral view illustrating a simple continuous operating volume amplified inflator with a cylinder thread degrading die.

Figure 10:
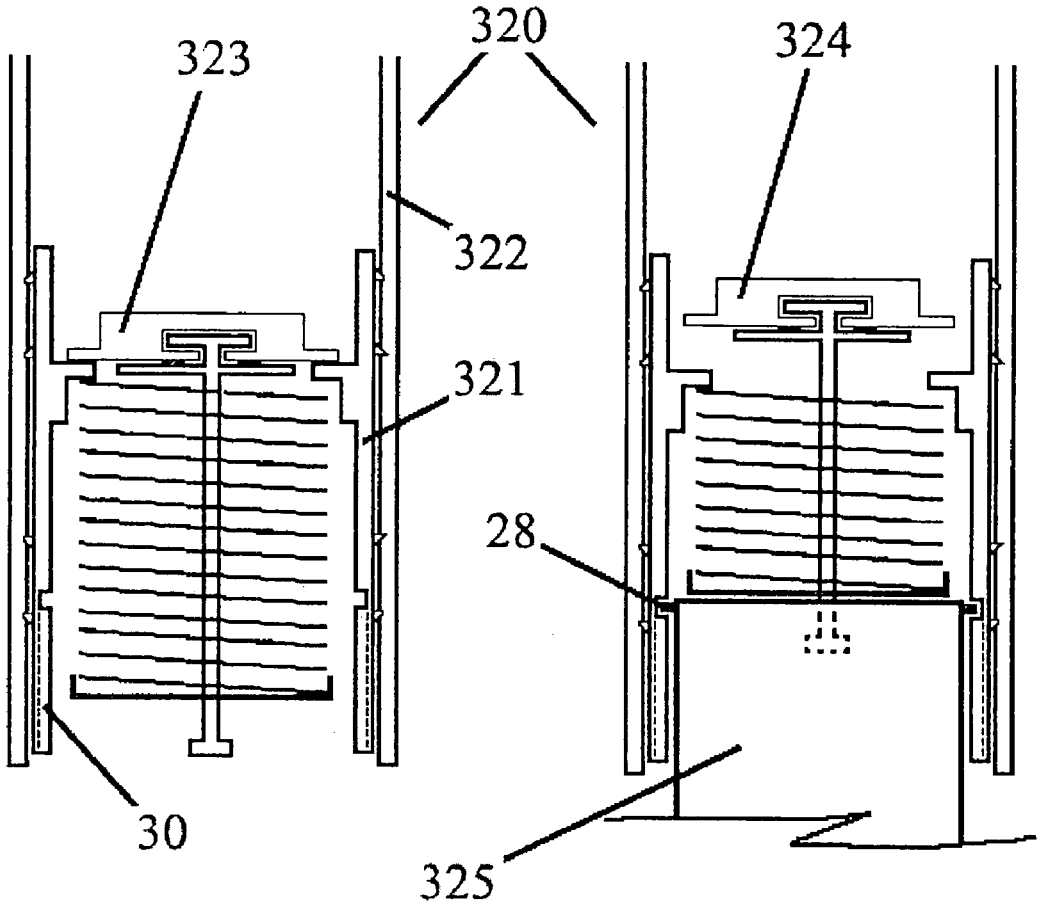

FIG. 10 is a lateral view illustrating an insert valve that integrates a mounting system for the venturi inflator. Once the inflator is removed the insert valve can be used for oral inflation or deflation.

DETAILED DESCRIPTION OF THE INVENTION

FIG. 1 shows a combined low-pressure volume amplified and rapid high-pressure but minimal volume inflator 1 with and without the valve means that allows regulated flow and shut off capacity as required for inflating multiple bladders. The upper drawing is of a low-pressure high-volume valve-regulated inflator 23 in which the CO2 cylinder is inserted into threaded cylinder receiver 33. The CO2 cylinder is advanced by cylinder complementary threads 6 towards an over sized nylon thread section 7 of receiver 33. The increased resistance of the nylon threads 7 alerts the user to the location of the cylinder within the inflator 1. Upon reaching the nylon threads the user provides one last full twist to advance the cylinder into the locking nylon thread section which prevents the cylinder from vibrating out of position. The last full turn of the cylinder also places the cylinder against the primary low-durometer outer gasket seal 3.

On intent to inflate the life jacket the cylinder is twisted into the inflator receiver 33 of FIG. 1 further compressing the soft primary O-Ring 3 which creates a secure pneumatic seal with the environment. Continued turning of the cylinder leads to compression of the secondary high-durometer central gasket seal 4 against rigid support 48. The secondary seal 4 is an integrated valve allowing intermittent operation of the volume-amplified inflator. As the operator continues to advance the cylinder into seal 4 the cylinder impales itself upon the micro-pierce means 5 which is embedded in a threaded mount 36. The threaded mount 36 supports the micro-pierce means 5, the primary O-Ring 3 and secondary valve seal 4. Once the cylinder seats against seal 4 backed by rigid support 48 and can no longer be advanced, the cylinder is then backed away from the secondary valve seal 4 and compressed gas flows through fenestration 8 in the Seal-Then-Pierce valve 2 into the conduit 46 through jet 34 as seen in the lower drawing of FIG. 1. The compressed gas is consolidated as it passes through the jet orifice 9. The diameter of jet orifice 9 in part determines the volume of the high-speed compressed jet stream focused on the center of the Venturi 35. The particular volume of the jet stream is actively regulated by the Seal-Then-Pierce valve 2. The jet stream then passes through the throat of Venturi 35. The performance of a particular Venturi is a balance of the Venturi throat diameter 26, throat angle 47, distance from jet orifice to throat 25, exit angle 26 and exit length 27. Restriction of Venturi length 27 to reduce the overall size of inflator 1 increases user compliance. Venturi design parameters are optimized for either quick inflation of a Personal Flotation Device or optimized to achieve maximum volume amplification as is required in order to inflate a life raft from a very small cylinder. Alternatively, valve 2 allows quick adjustment between rapid inflation and high-volume of inflation.

Figure 3:
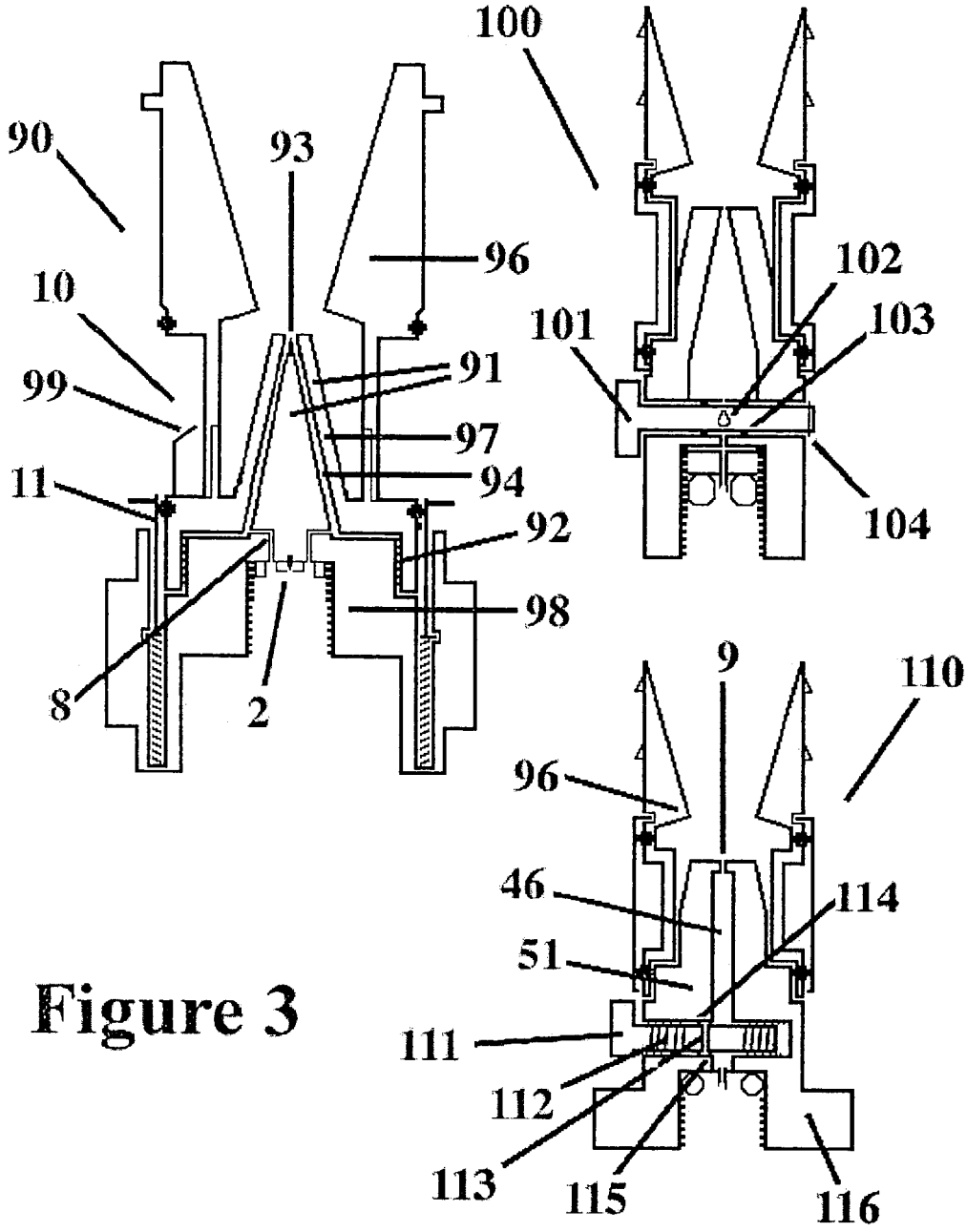
FIG. 3 is a lateral view illustrating a range of integrated valving mechanisms that allows stopping, restarting and regulation of the rate of flow of compressed gas. The shut off valve allows the same 16 gm CO2 to inflate multiple survival devices.

With a fixed Venturi design the inclusion of a valve such as the Seal-Then-Pierce valve 2 of FIG. 1, or a quarter turn needle valve 101 of FIG. 3 or a threaded spool valve such as 111 of FIG. 3 allows the operator to start, stop and vary the flow rate through the volume amplified inflator 1. That is the operator can optimize rate over volume to quickly fill the life jacket. Once the life jacket is inflated the valve can reduce flow rate to now optimize inflator 23 for increased volume over rate as needed to fill a voluminous life raft.

The top drawing in FIG. 1 of inflator 23 has longitudinal air intake vent cover 11 in the locked open position 21 so that the ambient air intake 10 is open to the environment. A rear quarter turn lock 14 holds cover 11 back against spring 12. On release cover 11 is pushed forward through quarter turn track 30 as spring 44 expands. The advance of cover 11 is arrested by stop 13. The vent cover 11 creates a seal by compressing rear O-Ring 15 and front O-Ring 17. Cover 11 rides up on forward support shelf 18 and abuts against forward stop 19 under spring tension 22 as seen in the lower drawing of FIG. 1.

In the lower drawing of FIG. 1 access to ambient air is blocked by vent cover 11 being in the forward or locked closed position 20. With the air intake 10 closed the inflator is now a high-pressure low volume inflator 24. Inflator 24 does not include a valve so upon micro-piercing of the cylinder, which is sealed from the ambient environment by single gasket 43, inflator 24 discharges continuously until the cylinder is spent. Such an economical inflator might be dedicated to the inflation of a life raft where the entire volume could be consumed by a single bladder. In the lower drawing the pierce means and fenestrations 45 are side by side.

The primary flow rate of volume amplified inflators is limited by the micro-pierce means 5 as seen in the upper drawing and lower insert drawing. This micro-pierce regulation leaves a nearly invisible perforation in the CO2 cylinder making the re-installation of a spent cylinder even more likely. Consequently the receiver of inflator 24 has integrated non-complementary cutting threads 38 and hardened burring gouge 39 to destroy and deform the threads on the used cylinder. The upper drawing depicts the traditional use of a beveled entrance 42 to guide the cylinder into the receiver and to help start the threads. In the lower drawing the bevel has been eliminated and the first threads are at the upper limit of size so that only very clean threads are allowed to enter receiver 33.

Both inflators in FIG. 1 are assembled from two pieces; the single piece cylinder receiver and jet-orifice 51 are threaded at 32 onto Venturi 35. When the inflator vent cover 11 is closed 20 the inflator functions as a high-pressure low-volume inflator 24 requiring that the joint between the jet-orifice and Venturi be sealed by O-Ring 31 to sustain the elevated pressures generated when inflator 1 functions as a high-pressure inflator.

Figure 2:
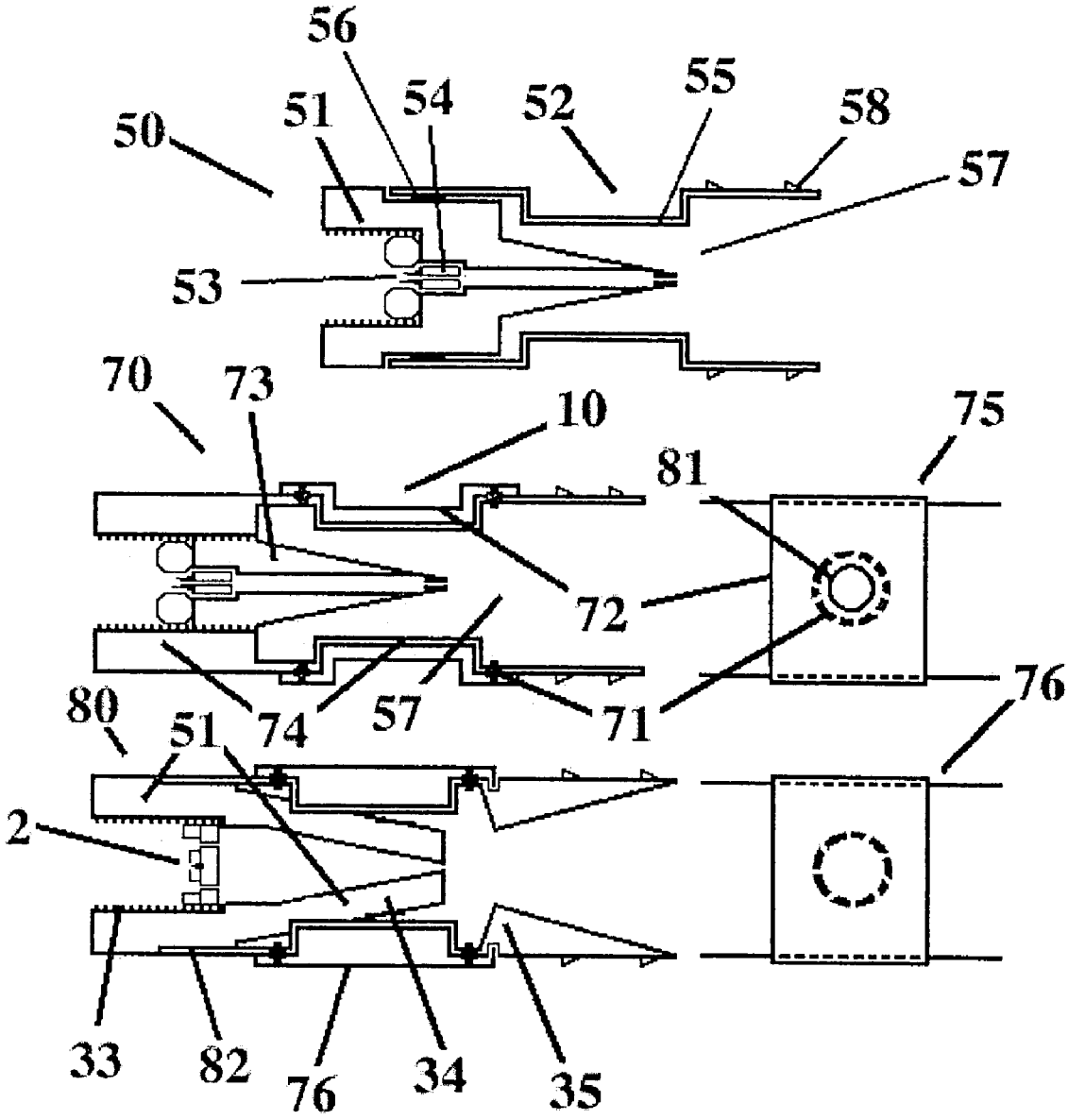

In FIG. 2 the upper drawing is of a very economical continuous discharge low-pressure volume amplified inflator 50. The intake vents are continuously open 52. A tubular pierce means 53 is press fit 54 into the single piece cylinder receiver-jet 51. The cylinder receiver-jet 51 is permanently attached to the vented inflator housing 55. The continuously vented inflator housing 55 creates simple injector volume amplification 57.

The center drawing of FIG. 2 is an another simple continuous discharge volume-amplified inflator that can function as a low-pressure or high-pressure inflator 70 due to inclusion of an intake vent cover 72. The economy of inflator 70 is that the receiver and inflator are made from a single piece 74. The pierce and jet means 73 are threaded into the receiver-inflator body 74. In the middle drawing the rotating barrel vent cover 72 is in the open position 75. The simple volume amplified inflator 70 draws in ambient air through intake 10 and through orifice 81 in the barrel cover 72. Even without incorporation of a Venturi the high-pressure air stream from the jet orifice draws in sufficient ambient air to allow a small cylinder to fully inflate a single large bladder PFD.

The lower drawing is of an inflator with Venturi amplification 35, and an on/off/variable flow valve 2 with barrel vent cover 72 capable of converting the inflator between high or low-pressure operation. This combination of features creates a 1 to 1 high-pressure direct inflation or a Venturi amplified volume inflated, variable-pressure, variable discharge duration and rate, variable displacement, compressed gas inflator 80 depicted in the vent closed position 76. In the insert to the right the rotating barrel vent 72 is in the closed position 76 in which gasket 71 seals the cover 72 to inflator body allowing high-pressure operation. In the sealed closed position the inflator functions as a traditional high-pressure low-volume inflator in which the final displacement is strictly limited to the amount of compressed gas available to expand once released from the cylinder.

In the lower drawing the inflator 80 is constructed from a single piece 51 threaded cylinder receiver 33 and jet 34 which is permanently attached such as by press fit or ultrasonic weld 82 to the Venturi component 35.

FIG. 3 illustrates a range of valving mechanisms which add a level of complexity to manufacture and cost but allow the inflator to conserve the compressed gas resources of a single cylinder to inflate a series of bladders. Seal-Then-Pierce valve 2, needle valve 101 or spool valve 111 not only act as on-off valves allowing inflation of multiple bladders but the incorporation of a valve also allows regulation of flow rate which is inversely proportional to the final displacement generated per gram of CO2.

The upper left hand drawing of FIG. 3 is of a nested orifice, Venturi amplified volume, variable-pressure, variable discharge duration and rate, variable displacement compressed gas inflator 90. Compressed gas passes through fenestration 8 into passageway 94 between the pair of nested jets 91. The diameter of passageway 94 can be varied by threaded adjustment 92. The passageway 94 can be reduced until orifice shut off plug 93 prevents any pressurized gas from exiting the jet. The nested jet inflator is comprised of three parts, the Venturi end piece 96, the outer jet piece 97 and the cylinder-receiver piece 98.

In the upper left hand drawing of FIG. 3 an oscillating means 99 is directed in towards the jet orifice such that if the downstream bladder is full the ambient air intake 10 is now converted to a pressurized air egress. As the gas moves from a zone of high pressure to ambient pressure an oscillating membrane 99 alerts the operator to convert the inflator 90 into a high pressure inflator by closing ambient air intake 10 with vent cover 11. Alternatively the operator can shut off the inflator by twisting the cylinder into the Seal Then Pierce/STP valve 2 or twist the nested jets 91 to shut off and thereby conserve the remaining pressurized gas for other survival devices such as distress markers, life rafts or air horns.

The upper right hand drawing of FIG. 3 is of a volume amplified inflator 100, specifically a Venturi amplified volume, variable-pressure, variable discharge duration and rate, variable displacement compressed gas inflator with in-line shut off and flow adjustment valve. Needle valve 101 turns to align eccentric orifice 102 allowing regulated release of the compressed gas. The eccentric orifice allows for a very gradual release of 800 psi compressed CO2. The needle valve 101 is sealed by needle valve O-Rings 103. The valve is held into the inflator body by valve retainer clip 104.

The lower right hand drawing of FIG. 3 is of a thread advanced spool valve, Venturi amplified volume, variable-pressure, variable discharge duration and rate, variable displacement compressed gas inflator 110. As the spool valve 111 is turned threads 112 very gradually advance the spool valve passageway 113 past/off the spool valve on/off O-Ring 115 allowing compressed gas to flow into the jet conduit 46 and out the jet orifice 9 toward the Venturi end piece 96. An outer O-Ring 114 seals the high-pressure portions of the valve from the environment. In threaded spool valve inflator 110 the single piece threaded cylinder receiver and jet 51 houses the thread advanced valve and includes oversized finger grips 116 to facilitate mounting the cylinder and regulating the inflator without straining the connection to the fabric bladder.

Figure 4:
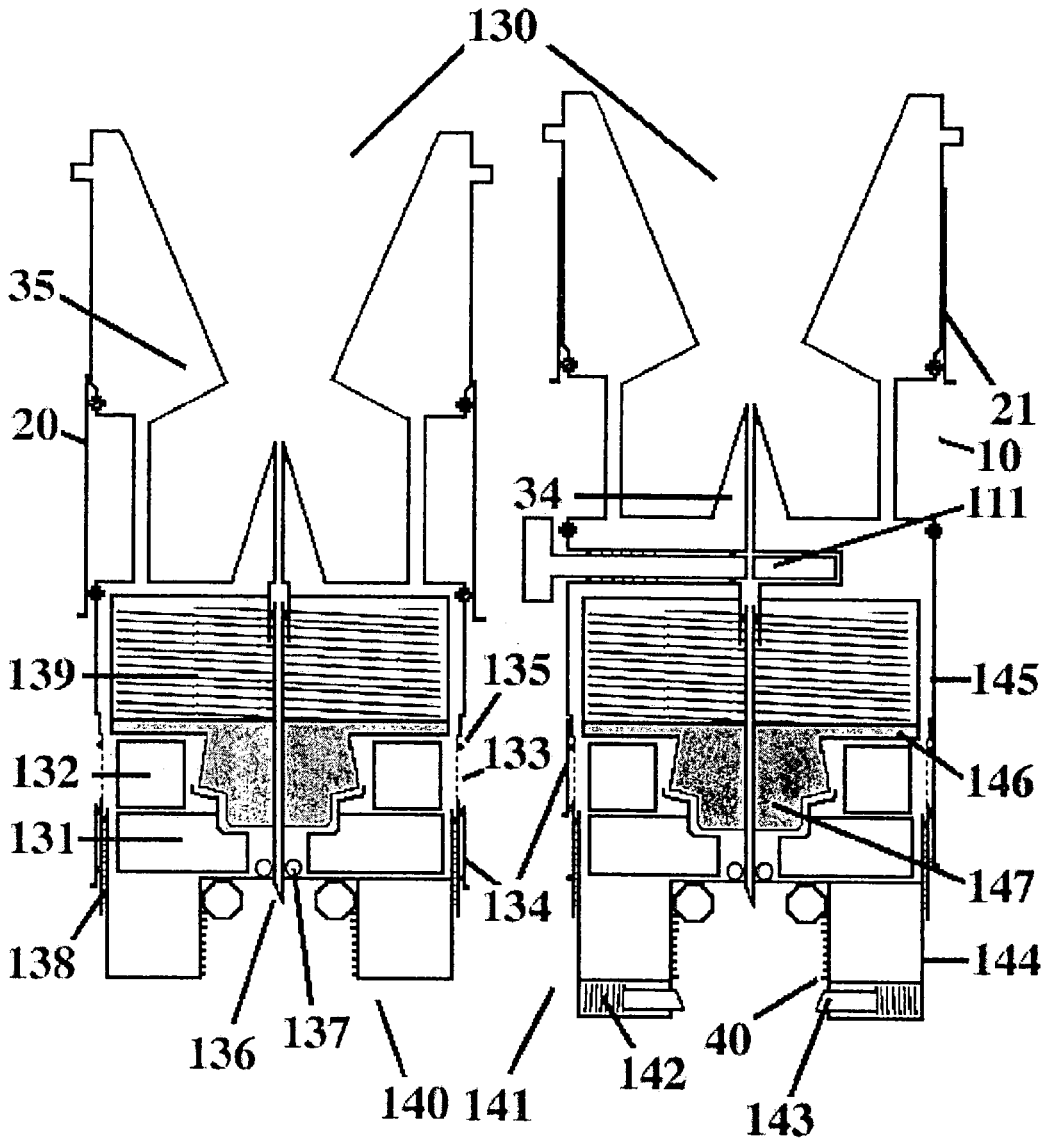
FIG. 4 is a lateral view of a combined water or manually activated, fixed displacement or variable displacement, low or high pressure compressed gas inflator. An optional spring-loaded cam thread degrader can retract during loading of the cylinder but can be forced out and degrade the cylinder threads during removal of the spent cylinder.

FIG. 4 is a pair of Water activated or manually activated Venturi amplified volume, variable-pressure, and variable displacement compressed gas inflators 130. In the inflator the water sensitive bobbin 131 is exposed or protected from access to water by sliding cover 134 which is sealed by O-Ring means 135. In the left hand drawing the cover is down exposing the fenestrations 133 to the environment and the inflator is set to function as a water or manually activated inflator 140. When cover 134 is in the up position as seen in the inflator on the right, the fenestrations 133 are sealed away from the environment and the inflator is in the manual-only activation mode 141. In both inflators the moveable pierce means 136 is sealed by pierce means O-ring 137 to prevent loss of high pressure compressed gas. In both inflators the lower portion of the inflator 144 threads together with upper portion 145 at thread 138. During threading water sensitive bobbin 131 pushes driver 147 which is an extension of driver plate 146 which compresses spring 139. The water sensitive bobbin 131 holds spring 139 in a state of compression. If the fenestrations 133 are exposed to water the bobbin 131 deteriorates and the driver 146 advances through bobbin 131 driving pierce means 136 through the CO2 cylinder seal.

The water-activated inflator on the right includes a threaded spool valve 111 that allows the compressed gas jet stream to be turned off and on to allow inflation of multiple bladders. The ability to regulate rate of flow allows rapid inflation of the life jacket and then slower volume-amplified inflation as required to inflate a high volume bladder such as a personal life raft.

During storage the fenestration cover 134 is in the closed position as seen in the right hand drawing of FIG. 4. During storage which can be typically 95% to 99% of the time for recreational life jackets, the silica gel bobbin 132 protects the water sensitive bobbin 131 from humidity extending the shelf life of the water sensitive inflator mechanism.

On the right side of FIG. 4 at the receiver end of inflator 141 a spring positioned cam 142 allows the hardened thread cutter-degrader 143 to move out of way during installation of the CO2 cylinder. However as the cylinder is being removed the cutter 143 is forced into the exiting threads destroying the threads so that the micro-pierced spent cylinder cannot pass back over the low tolerance entrance threads 40.

In the left hand drawing in FIG. 5 a full bore externally mounted radio frequency welded, coupler 150 slides over a standard RF weldable right angle connector 152. Specifically full bore fitting 151 slides over connector until dual function connector stop and valve seat 155 prevents further progress of coupler 151 over connector 152. Coupler 151 is a dual position externally mounted coupler that allows inflator integrated full bore check valve 153 to be operable in one position 154 then be compressed without twisting into a locked closed valve 163. A high flow check valve such as 153 is very soft and will fold upon itself if turned while contacting a surface. However a supple low resistance check valve such as 153 can be sealed by direct compression. The Inflator-coupler-check valve 157 integrates the check valve 153 at the end of the inflator. The inflator 157 includes quarter turn pin 28 that slides along the dual-position dual-locking quarter turn grooves 158 and high pressure seal is achieved by check valve O-Ring 156.

In the middle drawing of FIG. 5 the custom molded coupler 161 is integrated into the manufacture of the tubing connector 160. The coupler-connector is fused 162 during manufacture. In the second drawing the check valve is compressed 163 against seat 155.

In the right hand drawing of FIG. 5 an independent full bore inflate/deflate/check valve-coupler 170 includes finger grips 171. The coupler can be used separately as an oral inflate valve, removed to be a wide bore deflate valve or locked closed by compression against stop/valve seat 155. The mushroom flapper valve 153 mounts by way of mushroom valve post 159 onto coupler 170.

In the lower left hand corner of FIG. 5 inflator 157 is connected via inflator mount means 28 to a combined oral/compressed gas air horn 172 and quarter turn mount means 177 on the air horn 172. The air horn 172 is self orienting due to inclusion and positioning of ballast moment 173 and buoyant moment 174. Valve 101 provides flow/volume control for air horn 172. Nano-pierce orifice 176 further reduces the flow rate from volume amplified inflators. Compressed gas cylinders such as O2 or CO2 supply the pressure that is coupled through inflator 157 and valve 101 to air horn 172. An oral check valve 175 allows oral use of the air horn 172 if there is no remaining compressed gas. Either oral or cylinder compressed gas vibrates membrane 178 producing a piercing audible alarm.

In the lower right hand insert of FIG. 5 shows a detail of the dual-position quarter turn safety lock coupler or valve-coupler 180. The quarter turn entrance 182 leads to the quarter turn right angle groove 186. At the end of the quarter turn groove the inflator 157 or coupler 170 is pulled back over locking ridge 181 into the check valve operating position 185 or pushed forward over locking ridge into a continuously tensioned compressed-closed position 184. The locking ridge applies continuous pressure against the valve and seat converting the check valve into a secure shut off valve. Two locking ridges 181 create friction locks to secure the full bore amplified volume inflator check valve 157 or the full bore valve coupler 170 in either the locked open position 185 or locked closed 184. In either the locked open 185 or locked closed 186 position the side safety lock 183 prevents the inflator or coupler from turning left or right.

In FIG. 6 the micro-pierced cylinder 202 when re-installed contributes to the high rate of failure of fielded inflatable products. The most economical solution is to degrade the threads 200 on installation or removal so that the micro-pierced cylinder cannot be installed a second time yet the volume amplified inflator can be reliably and economically operated with off the shelf CO2 cylinders. In the top row the full CO2 cylinder 201 is capped with a brilliant green cap which is removed before or during installation. Under the green coating can be a normal cylinder 202 or red anodized threads further visually indicating a cylinder's used status. In the lower row on the left of FIG. 6 is a full cylinder which has been dipped in a bi-refringent coating 204. Upon release of the approximately 800 PSI of gas the cylinder diameter reduces sufficiently to create a change in the iridescent coating signaling a spent cylinder 205. Alternatively a plastic collar 206 is removed during installation helping visually impaired or nocturnal re-arming.

In FIG. 7 MOB 249 is manually orienting the cylinder 230. MOB 249 is responsible for keeping the pierced cylinder vertical 231 regardless of the size of the direction of size of the waves 234. Simultaneously the MOB 249 is converting the default mode of operation, high-pressure low-volume, into a high-volume low-pressure inflator by manually holding the venturi cover 11 in the open position 232, thereby exposing the ambient air intake 10. The operator is responsible for assuring that air rather than water is entrained during inflation of raft 236. By holding the cylinder vertical 231, the remaining Liquid compressed CO2 stays at the bottom of the cylinder 248 at the opposite end from the pierced orifice in the cylinder seal.

In FIG. 7 the MOB 249 is wearing a double chambered inflatable PFD such as a SOLAS PFD 241. The SOLAS PFD is required to have two chambers in this case an upper chamber 244 which is automatically inflated upon contact with the water. An existing UL Approved water activated inflator 242 has been retrofitted with a valve and venturi so that if the operator so chooses the upper chamber can be slowly inflated utilizing the venturi conserving the vast majority of the compressed liquid CO2 233 for use in inflating other devices or operating an air horn. Of note the optional venturi operation requires the operator to keep the cylinder vertical and free of water while the ambient air intake is held open. In addition a pivoting CO2 manifold 246 allows the cylinder to be positioned vertically so that only gas and not compress liquid gas can be passed through the inflator. A middle gas retentive layer 243 divides the upper chamber 244 from the lower chamber 245. Since the upper chamber 244 and lower chamber 245 share a common wall 243 this dual chamber design can only benefit from inflation of a single chamber. Given reliable operation of the water activated inflation system and chamber, the redundant manual inflator 237 can be removed from the lower chamber 245 and used to inflate raft 236. The UL listed manual inflator 237 is retrofitted with a simple continuous discharge, single use, low-pressure volume amplified inflator 240. This volume amplifying add on is similar to item 50 in FIG. 2. That is once the UL listed inflator is jerked to pierce the cylinder the entire contents will be passed through the inflator and retrofit venturi until spent. Raft 236 provides 300 lb of displacement yet can be fully inflated by a volume amplified 38 gm CO2. Of note the same 38 gin CO2 when used in the default or traditional rapid, high-pressure, low-volume mode of operation it only generates approximately 35 lbs of displacement. If the MOB 249 elects to manually inflate the lower chamber 245 of his PFD 241 and then manually inflates the majority of his raft, use of the upper inflator which includes an on-off valve a small portion of high pressure gas to be used to top of the raft to approximately 2.5 psi. Once the raft is rigid the operator can turn off the gas with inflator 242 preserving the residual gas 233 for operation of the air horn 172 as seen in FIG. 5.

Once the raft 236 is inflated in FIG. 7, the regulated venturi retrofit inflator 242 is disconnected by quick disconnect means 28 from the bladder mount quick disconnect means 235 and cap 238 used to provide secure pneumatic seal. The remaining compressed gas is then available for operating other safety gear.

FIG. 8 is lateral view of UL listed inflators that have been retrofitted with venturi amplification. A UL listed water activated inflator 260 is seen in the lower drawing of FIG. 8. After puncture of the cylinder the compresses gas enters the venturi through the usual orifice 265 in inflator 260. It passes through valve 101 then through jet orifice 9. The stream of high speed gas pulls in ambient air through intake 10 that is open because the rotating barrel cover 75 which is aligned to the orifice in the barrel cover 81 is aligned over the ambient air intake orifice 10 in the venturi. A releasable pneumatic coupler sleeve 269 is O-ring sealed 271 to quick release coupler and valve which is welded 267 to bladder 266. A mushroom check valve 153 is mounted on post 159. The Quick Release sleeve 269 is locked onto the bladder valve by keeping the locking balls 270 tight with groove 268 in the manifold stem 275. The locking sleeve 269 allows the inflator to pivot about the manifold stem 275 by the weight of the cylinder and gas 239.

In the upper corner of FIG. 8 UL listed manual inflator 261 is mounted onto a threaded chamber 264 that receives the compressed gas. UL listed nut 263 secures the retrofitted simple venturi 240 in place on the existing manual inflator 261. Quick disconnect means 28 allows the retrofitted manual inflator to mount onto a pivoting coupler 274 with an integrated check valve. The connection is sealed with O-ring 273 A permanent snap lock cover 272 allows for pivoting of the venturi inflator about bladder check valve. Quarter turn entrance groove 182 receives quick disconnect mounting means 28 built into the end of the venturi inflator. Once the raft is inflated a sealing cap 238 can be mounted and sealed by O-ring 273 to prevent slow leaks through mushroom valve 153 as identified in the lower drawing.

In FIG. 9 an CO2 inflator of any type with cylinder thread degrader/eraser with cylinder position indicator 290 has a drive pin 291 that is pushed up as the cylinder is threaded in. The force is turned about a pivot 292 to force a die cutter 293 along a cam 296 into a position tight about the neck of the cylinder. The die cutter has a transition thread section 294 which changes into the new thread section 295. A the force applied during threading the cylinder into the inflator 290 is re-directed into relocating the cutter tie. A locking cog 297 keeps the cutting die 293 in place as the cylinder is removed. A release 298 is operable only after the spent cylinder is free of the inflator 290. After removal of the spent cylinder with degraded threads the inflator the cylinder will fall away being unable to engage with the fine threads 40.

As the same drive pin 291 advances a red color 299 indicating the cylinder is out of position converts to green 300. An indicator window 301 allows the user to quickly determine if the inflator has a good cylinder in the correct position.

In FIG. 10 insert valve 321 is found inside oral inflation tube 322. The valve is in the normally closed position 323. Insert valve 321 has been modified to include quarter turn track 30 allowing the inflator mounting means 28 to hold the venturi nozzle 325 in place which concurrently holds the valve in the open position 324 so that the least resistance possible opposes the low pressure ambient air entrained inflation.

INDEX OF REFERENCE NUMERALS

1 Combined High-Pressure Low Volume Low-Pressure Volume Amplified Intermittent Inflator
2 Seal-then-pierce valve
3 Primary low-durometer outer gasket seal
4 Secondary high-durometer central gasket seal
5 Micro-pierce flow regulator means
6 Compressed gas cylinder complementary mounting threads
7 Nylon oversized sealing threads
8 Seal and pierce fenestration

9 Jet orifice
10 Ambient air intake vent
11 Longitudinal air intake vent cover
12 Vent cover spring compressed
13 Vent cover stop
14 Vent cover rear ¼ turn locked open
15 Vent cover front ¼ lock closed
16 Vent cover rear O-Ring seal
17 Vent cover front O-Ring seal
18 Vent cover forward support self
19 Vent cover forward stop
20 Vent cover locked closed
21 Vent cover locked open
22 Vent cover handle
23 Low pressure high volume intermittent discharge inflator
24 High pressure low volume continuous discharge inflator
25 Venturi throat to orifice distance
26 Venturi throat diameter
27 Venturi throat to exit length
28 Inflator quick disconnect mount means
29 Venturi angle
30 Quarter turn track
31 Receiver-jet/orifice to Venturi O-Ring seal
32 Receiver-jet/orifice to Venturi threads
33 Threaded cylinder receiver
34 Jet
35 Venturi
36 Thread mounted seal then pierce valve
37 Embedded thread degrading receiver
38 Non-complementary cutting threads
39 Hardened burring gouge
40 Maximum size starting thread,
41 No starting bevel
42 Traditional thread starting bevel
43 Sole cylinder gasket
44 Vent cover spring compressed
45 Receiver fenestrations
46 Jet conduit
47 Venturi throat angle
48 Rigid seat supporting shut off seal
50 Simple continuous discharge low-pressure volume amplified inflator
51 Single piece threaded cylinder receiver and jet
52 Continuously open draw vents
53 Tubular pierce means
54 Pierce means pressed mounted
55 Vented inflator housing
56 Ultrasonic weld or permanent attachment means
57 Simple injector volume amplification
58 Barbed volume amplified inflator attachment means
70 Simple continuous discharge high-pressure constant volume or low-pressure amplified volume inflator
71 Draw vent gasket seal
72 Rotating barrel vent cover/vent fenestration
73 Thread mounted jet and pierce means
74 Single piece threaded cylinder receiver and vented inflator housing
75 Rotating barrel vent cover in the air intake open position
76 Rotating barrel vent cover in the air intake closed position
80 Venturi amplified volume, variable-pressure, variable discharge duration and rate, variable displacement compressed gas inflator
81 Barrel cover orifice
82 Press fit/permanent attachment between receiver and inflator body
90 Nested orifice, Venturi amplified volume, variable-pressure, variable discharge duration and rate, variable displacement compressed gas inflator
91 Nesting jets
92 Threaded adjustment for nested jets
93 Orifice shut off plug
94 Nested jets passageway
96 Venturi end piece
97 Outer jet piece
98 Cylinder receiver piece
99 Off-gassing audible reed alarm
100 Venturi amplified volume, variable-pressure, variable discharge duration and rate, variable displacement compressed gas inflator with in-line shut off and flow adjustment valve
101 Needle valve
102 Eccentric valve orifice
103 Needle valve O-Rings
104 Valve retainer clip
110 Thread advanced spool valve Venturi amplified volume, variable-pressure, variable discharge duration and rate, variable displacement compressed gas inflator
111 Spool valve
112 Spool valve threads
113 Spool valve passageway
114 Spool valve outer O-Ring
115 Spool valve on/off O-Ring
116 Inflator grasp flange
130 Water activated or manual activated Venturi amplified volume, variable-pressure, variable displacement compressed gas inflator
131 Water sensitive bobbin
132 Silica gel bobbin
133 Water access fenestrations
134 Water access fenestration cover
135 Water access fenestration cover O-Ring
136 Manual or spring driven cylinder seal moveable pierce means
137 Pierce O-Ring seal
138 Spring compression threads
139 Piercing spring
140 Water activated inflator
141 Manually activated water proof inflator
142 Spring positioned cam
143 Hardened thread cutter/degrader
144 Lower portion of water activated inflator
145 Upper portion of water activated inflator
146 Driver plate
147 Spring loaded, bobbin retained driver
150 Full-bore radio frequency welded coupler-connector
151 Dual position externally mounted full-bore coupler-check valve seat
152 Standard radio frequency weldable right angle connector
153 Mushroom check valve
154 Check valve in operable position
155 Coupler insertion stop and check valve seat
156 Check valve O-Ring
157 Inflator-coupler-check valve
158 Dual-position dual-locking quarter turn grooves
159 Mushroom valve post
160 Composite manufactured connector-coupler
161 Custom molder coupler
162 Coupler and connector fused during manufacture
163 Check valve compressed closed
170 Full bore inflate/deflate/check valve-coupler
171 Finger grips

172 Oral or compressed gas signal air horn
173 Self-Orienting integrated ballast moment
174 Self-Orienting integrated buoyant moment
175 Oral check valve
176 Nano-pierce regulator
177 Locking open quarter turn mount
178 Oscillating membrane
179 Compressed gas cylinder
180 Dual position quarter turn safety lock coupler or valve-coupler
181 Locking ridge
182 Quarter turn entrance groove
183 Quarter turn side safety lock
184 Continuously tensioned compressed-closed position
185 Locked open position
186 Right angle quarter turn groove
200 Degraded threads on spent cylinder
201 Green thick soft plastic coating
202 Normal uncoated threads
203 Red anodized under coat
204 Bi-refringent coating applied to distended full cylinder
205 Collapsed empty cylinder alters light sensitive coating
206 Thin plastic disc, diameter of cylinder
230 Manually oriented and operated volume amplified inflator
231 Operator oriented vertical compressed liquid CO2 cylinder
232 Venturi vent cover manually held open
233 Residual liquid propane at bottom because vertical
234 Waves at water's surface
235 Bladder mounted quick disconnect
236 Partially inflated life raft
237 UL listed manual CO2 inflator retrofitted with volume amplification means
238 Sealing cover cap
239 Weight of cylinder and gas allow establishment and maintenance of the vertical operational orientation.
240 Retrofit simple continuous discharge, single use, low-pressure volume amplified inflator(see 50)
241 Safety Of Life At Sea/SOLAS class dual chambered 35 lb life jacket
242 UL listed water activated/manual inflator retrofitted with valve regulation and volume amplification venturi
243 Middle layer of fabric separating the chambers
244 Upper water activated chamber, inflated
245 Lower manually activate chamber reserve chamber, not inflated
246 Pivoting inflator mounting means combined with manifold means
247 Venturi inflator/pivoting manifold placed high on PFD positioning it out of the water
248 Operator responsible for keeping liquid CO2 at bottom of cylinder, away from pierced orifice in cylinder seal
249 Man Over Board
250 38 gm CO2
260 UL listed 6F water activated CO2 inflator
261 UL listed manual inflator
262 Manual pull lanyard and jerk tab
263 UL Approved nut
264 Threaded compressed gas chamber
265 Compressed gas chamber entrance orifice
266 Bladder wall
267 Pivoting manifold hermetic seal/weld
268 Grooves in pivoting manifold
269 Locking sleeve of releasable pneumatic coupler
270 Locking balls held in position by spring loaded cover
271 Rotating Cap O-Ring
272 Snap lock cover cap
273 O-Ring
274 Pivoting Venturi coupler with integrated low resistance wide-bore check valve coupler
275 Manifold stem
290 Generic inflator with cylinder thread degrader/eraser and cylinder position indicator
291 Drive pin
292 Pivot
293 Cutting Die
294 Transitional cutting teeth
295 New thread pattern
296 Cam drives die into position
297 Locking advance cogged wheel
298 Lock release
299 Red visual indicator cylinder is out of position
300 Green visual indicator cylinder is in position
301 Cylinder position indicator window
320 Combined insert valve and venturi inflator mount
321 Insert oral inflation valve
322 Oral inflation tube
323 Valve in normally closed position
324 Valve held in the open position
325 Nozzle end of venture The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A compressed gas inflator, comprising:

a compressed gas cylinder receiver having an internal channel, said internal channel having a first end and a second end and comprising a first section containing a plurality of threads and a second section, said second section having an orifice disposed at the second end of said internal channel;

a cylinder piercing assembly disposed within the internal channel, said piercing assembly comprising a piercing member, a piercing member positioner and at least one sealing member, said positioner having a fenestration extending therethrough providing communication between the first section of the internal channel and the second section of the internal channel;

a Venturi body member defining an internal passageway in communication with said internal channel of said cylinder receiver through said orifice, said passageway having a first section and a second section, said second section of said passageway having a tapering inward diameter shape; and an air intake vent assembly in communication with the internal passageway of said Venturi, said air intake vent assembly including a movable cover to allow the air intake vent assembly to be in either an open position to allow ambient air intake or in a closed position for high-pressure low-volume use.

2. The compressed gas inflator of claim 1 wherein said Venturi body member is attached to said compressed gas cylinder receiver.

3. The compressed gas inflator of claim 1 wherein said plurality of threads includes a first portion of starting threads and a second portion of non-complementary cutting threads.

4. The compressed gas inflator of claim 1 wherein said at least one sealing member is a first outer gasket and a second central gasket; wherein a first end of said fenestration disposed between said first outer gasket and said second central gasket, wherein said piercing member is surrounded by said second central gasket.

5. The compressed gas inflator of claim 1 further comprising means for controlling the flow of gas out of a cylinder attached to said cylinder once the cylinder has been in pierced by said piercing member.

6. The compressed gas inflator of claim 5 wherein said means for controlling comprising:

a second internal channel defined by said cylinder receiver intersecting with said first internal channel;

a valve member disposed within said second internal channel; and means for maintaining said valve within said second internal channel.

7. The compressed gas inflator of claim 6 wherein said valve member is a spool valve having a passageway therethrough.

8. The compressed gas inflator of claim 7 wherein said means for maintaining is at least one set of threads disposed within said second internal channel at least one set of mating threads disposed on a stem portion of said spool valve.

9. The compressed gas inflator of claim 6 wherein said valve member is a needle valve having an orifice extending therethrough, wherein said turning needle valve aligns the needle valve orifice to permit communication between said first section of said first internal channel and said second section of said first internal channel.

10. The compressed gas inflator of claim 9 wherein said means for maintaining is a retaining clip.

11. The compressed gas inflator of claim 9 wherein said means for controlling further comprising a first o-ring disposed within said second internal channel on a first side of said needle orifice and a second o-ring disposed within said second internal channel on a second side of said needle orifice.

12. The compressed gas inflator of claim 1 wherein said positioner having a set of threads for mating with a portion of the threads of the first section of said first internal channel.

13. The compressed gas inflator of claim 1 further comprising means for degrading the threads of a cylinder attached to said cylinder receiver.

14. The compressed gas inflator of claim 13 wherein said means for degrading comprises a hardened burring gouge.

15. The compressed gas inflator of claim 1 wherein said inflator further comprising a means for water activation of said piercing member.

16. The compressed gas inflator of claim 15 wherein said means for water activation comprising:

a water sensitive bobbin; and a spring member;

wherein said water sensitive bobbin maintains said spring member in a compressed state which causes said piercing member and positioner to be in a non-piercing position; wherein upon exposure to water said water sensitive bobbin water deteriorates allowing the spring member to move to a less compressed state which moves the positioner and piercing member to permit piercing of a cylinder attached to said cylinder receiver.

17. The compressed gas inflator of claim 16 wherein said means for water activation further comprising a non-water sensitive bobbin disposed between said spring member and said water sensitive bobbin.

18. A compressed gas inflator, comprising: a compressed gas cylinder receiver having an internal channel containing a plurality of threads; a cylinder piercing assembly disposed within the internal channel; a Venturi body member defining an internal passageway in communication with said internal channel of said cylinder receiver; and an air intake vent assembly in communication with the internal passageway of said Venturi, said air intake vent assembly including a movable cover to allow the air intake vent assembly to be in either an open position to allow ambient air intake or in a closed position for high-pressure low-volume use;

wherein said cylinder piercing assembly includes a primary low-durometer outer gasket seal, a secondary high-durometer central gasket sear and a micro-pierce flow member.

19. The compressed gas inflator of claim 18 wherein a cylinder attached within said receiver is first sealed before being pierced by said cylinder piercing assembly.

20. A compressed gas inflator, comprising: a compressed gas cylinder receiver having an internal channel containing a plurality of threads; a cylinder piercing assembly disposed within the internal channel; a Venturi body member defining an internal passageway in communication with said valve; and an air intake vent assembly in communication with the internal passageway of said Venturi, said air intake vent assembly including a movable cover to allow the air intake vent assembly to be in either an open position to allow ambient air intake or in a closed position for high-pressure low-volume use;

wherein said plurality of threads includes a first portion of compress gas cylinder complementary mounting threads and a second portion of nylon oversized sealing threads.

* * * * *